United States Patent [19]

Iams

[11] Patent Number: 4,720,209

[45] Date of Patent: Jan. 19, 1988

[54] DRYWELL STRUCTURE

[76] Inventor: Donald R. Iams, 4530 W. Buffalo St., Chandler, Ariz. 85226

[21] Appl. No.: 913,266

[22] Filed: Sep. 30, 1986

[51] Int. Cl.[4] ..... E02B 11/00

[52] U.S. Cl. ..... 405/36; 210/165; 405/45; 405/50

[58] Field of Search ..... 405/36, 43, 45, 40, 405/41, 50; 210/163, 164, 165

[56] References Cited

U.S. PATENT DOCUMENTS 528,888 11/1894 McGill ..... 405/43

1,129,324 2/1915 Appelman ..... 405/45

3,946,762 3/1976 Green ..... 405/45 X 4,199,272 4/1980 Lacey ..... 405/36

*Primary Examiner*—David H. Corbin

*Attorney, Agent, or Firm*—Herbert E. Haynes, Jr.

[57] ABSTRACT

A drywell structure for receiving drain water from a ground surface and directing it to subterranean levels for leaching the water into the subterranean soil is provided with a water filtration and intake assembly which filters silt and other foreign matter from the received drain water prior to its being directed to the subterranean soil.

19 Claims, 3 Drawing Figures

DRYWELL STRUCTURE

BACKGROUND OF THE INVENTION

1. Field of the Invention

This invention relates in general to drywells and more particularly to a drywell structure which utilizes a filtration principle to prevent silt and other foreign materials from being transported by the drain water into the subterranean levels.

2. Description of the Prior Art

As is known in the art, a drywell is a structure formed in the earth for receiving water such as from a street after a storm, a roof drain system, floor drain system, or the like and draining that water into a permeable subterranean soil. Typically, a drywell is drilled, or otherwise formed in the ground so as to extend from ground level into permeable soil and the drywell is backfilled with selected rocks. A settling chamber defined by a concrete liner is located in the upper end of the drywell with a manhole cone on its upper end. A cast iron ring and grate are provided in the top of the manhole cone to receive the water to be drained, and the otherwise open bottom end of the setting chamber is closed with a porous filter fabric. In some instances, the lower portion of the concrete liner is provided with drain holes that extend laterally from the settling chamber into the rock-filled drywell. An imperforate overflow pipe extends upwardly from the bottom of the settling chamber and a cylindrical large mesh debris screen extends coaxially upwardly from the open upper end of the overflow pipe. A preforated drain pipe depends from the lower end of the overflow pipe through the rock-filled drywell and an injection screen is mounted on the lower end of the drain pipe.

When drain water is received in the drywell structure, it will enter and fill the settling chamber to the level of the open upper end of the overflow pipe. When filled to this level, drainage will begin in an overflow manner via the overflow pipe, drain pipe and injection screen through the rock interface into the permeable soil. When and if the permeable soil becomes saturated, water flow through the injection screen will be reduced and the flow rate will be increased through the multiple apertures of the perforated drain pipe. And, water will also flow out of the settling chamber through the filter fabric provided in its bottom end and through the lateral drain holes formed in the lower portion of the concrete liner.

As in most, if not all, water drainage, some silt and other foreign matter will be carried by the water into the settling chamber. The ideal result will be that the silt and non-floating foreign matter will settle to the bottom of the settling chamber and the floating foreign materials will be prevented from entering the overflow pipe by the debris screen, and periodic cleaning of the settling chamber is needed to remove the settled materials.

Even when the settling chamber of such a prior art drywell is clean, not all of the silt and other foreign materials will settle out, particularly when incoming water flow is heavy such as during and immediately after a storm. As the settling chamber becomes filled, this problem is aggravated and can become critical if the required cleaning of the settling chamber is neglected.

The silt and other foreign materials which enter the overflow pipe and are carried to subterranean levels result in contamination of the drywell which at first reduces its water dissipation capabilities and eventually destroys the useful life of the drywell. The silt and other foreign materials form a cake which clogs the porous soil around the drywell and clogs the rock back fill. When this occurs, the drywell must be abandoned.

Therefore, a need exists for a new and improved drywell structure which overcomes, or at least substantially reduces, the problems and shortcomings of the prior art.

SUMMARY OF THE INVENTION

In accordance with the present invention, a new and improved drywell structure is disclosed which eliminates, or at least substantially reduces, the prior art problem of silt and other foreign materials from being transported with the drain water to the subterranean levels into which the drywell extends.

The drywell structure of the present invention includes the usual settling chamber defined by a concrete liner which is open at its top and bottom ends. A manhole cone extends upwardly from the open top end of the liner to proximate the ground level and has the usual ring and grate assembly in the top of the manhole cone. The bottom end of the settling chamber is closed by a suitable filter fabric.

When a drywell is being constructed in accordance with conventional techniques, it is drilled or otherwise excavated to achieve a desired drainage capacity and reach permeable soils and is of a size which allows it to be back filled with a cleaned pre-selected rock back fill. The rock back fill, or rock pack, substantially surrounds the concrete liner of the settling chamber and extends downwardly into the permeable soil.

In accordance with the present invention, the imperforate overflow pipe and screen which is located in the settling chamber of prior art drywell structures, is replaced by a water filtration and intake assembly which includes a perforated water intake pipe which extends upwardly from the bottom of the settling chamber, is closed on its upper end, and has a filter fabric wrapped thereon.

The preferred filter fabric which is wrapped around the perforated water intake pipe is sometimes referred to as a geotextile or geotechnical fabric and is a non-woven synthetic fabric of a type developed specifically for soil engineering purposes and is used generally as a soil/water filtration medium for controlling sedimentation runoff, soil erosion and the like.

When drain water enters the drywell structure of the instant invention it will begin exiting the settling chamber immediately by passing through the filter fabric into the perforated intake pipe. The filter fabric will filter out most, if not all, of the silt and other foreign matter causing it to remain in the settling chamber. The drain water entering the intake pipe is transported to the subterranean levels and is leached into the subterranean soils in the usual manner.

In that the drywell structure of the present invention operates on a filtration principle, rather than an overflow/settling principle, as in the prior art, most of the silt and other foreign matter which contaminates and ultimately destroys drywells, is prevented from doing so, and this extends the useful life of a drywell almost indefinitely.

Accordingly, it is an object of the present invention to provide a new and improved drywell structure for directing drain water into subterranean soils.

Another object of the present invention is to provide a new and improved drywell structure which employs a filtration assembly which prevents silt and other foreign materials from being carried by the drain water into the subterranean levels.

Another object of the present invention is to provide a new and improved drywell structure of the above described character wherein the filtration assembly includes a drain water intake pipe which extend upwardly from the bottom of a setting chamber. The intake pipe is perforated, has its upper end closed and is wrapped with a filter fabric which prevents the silt and other foreign materials from moving with the drain water into the intake pipe on its way to the subterranean levels.

The foregoing and other objects of the present invention as well as the invention itself, may be more fully understood from the following description when read in conjunction with the accompanying drawings.

DESCRIPTION OF THE PREFERRED EMBODIMENT

Figure 1:
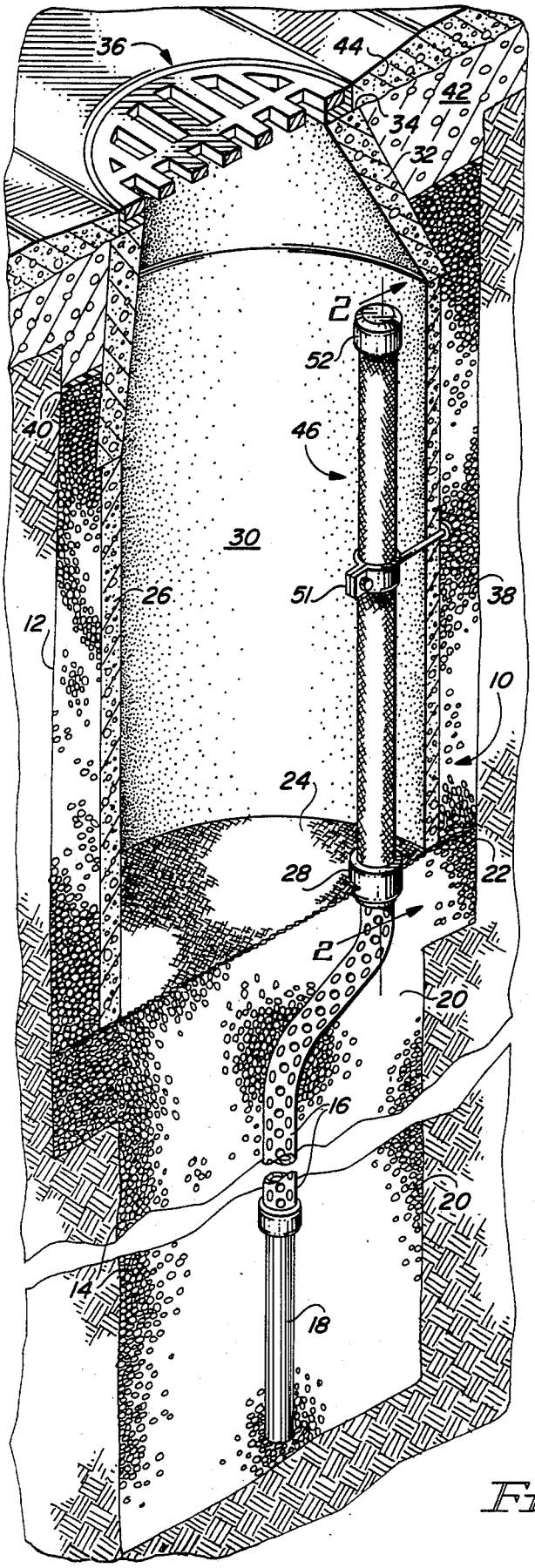
FIG. 1 is a perspective sectional view taken along a vertical plane through a ground formation to show the various features of the drywell structure of the present invention.
Figure 2:
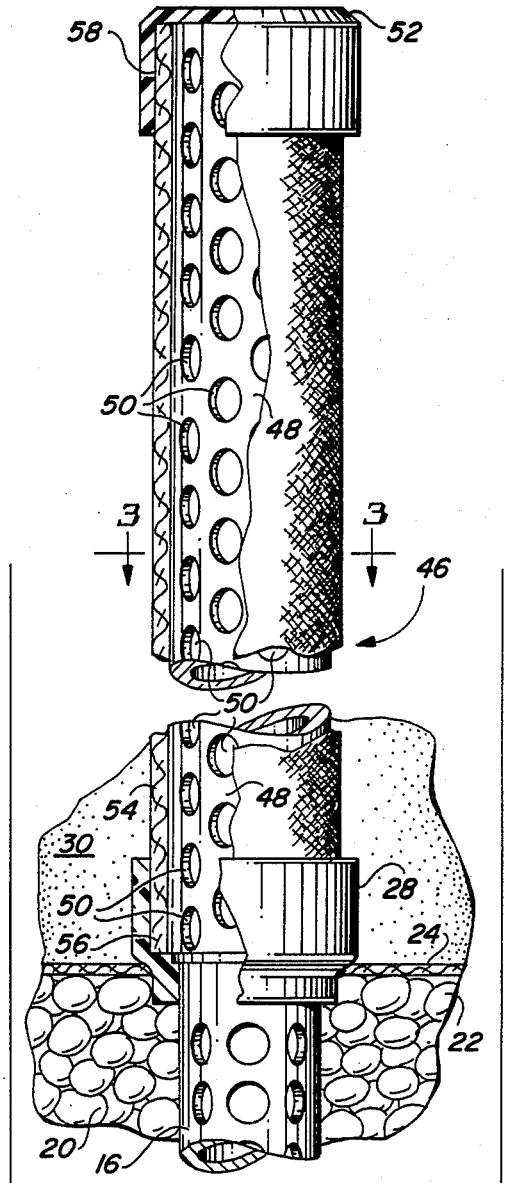
FIG. 2 is an enlarged fragmentary sectional view taken along the line 2—2 of FIG. 1.

Referring more particularly to the drawings. FIG. 1 shows a drywell structure which is indicated generally by the reference numeral 10. Although drywell structures per se will differ in some of the structural details, the following description of the drywell 10 is intended to be exemplary of such structures.

When a drywell structure is being constructed in accordance with standard techniques, it is drilled or otherwise excavated to a depth necessary to reach clean permeable soils and is typically formed with a relatively large diameter portion 12 proximate the ground level and a reduced diameter portion 14 extending to the permeable soils. The diameter and depth dimensions of the lower and upper portions 12 and 14 are determined by flow capacity and the like.

A perforated drain pipe 18 is located in the reduced diameter lower portion 14 of the drywell with its upper end extending into the larger diameter portion 12. An injection screen 18 is provided on the lower end of the drain pipe 16. When the drain pipe 16 and injection screen 18 are in place, the reduced diameter lower portion 14 of the drywell 10 is backfilled with cleaned pre-selected rocks to provide a rock pack 20 which extends up into the larger diameter portion 12 to a level indicated at 22.

A sheet of filter fabric 24 is placed atop the rock pack 20 and a prefabricated concrete liner 26 is lowered into the larger diameter upper portion 12 so as to rest on the filter fabric 24 and thus be supported on the rock pack 20.

The concrete liner 26 is usually of cylindrical configuration with its otherwise open bottom end being closed by the above described filter fabric 24 and the rock pack 20. As shown, the upper end of the perforated drain pipe 16 has coupler fitting 28 thereon for reasons which will hereinafter be described in detail, and that fitting extends through the filter fabric 24 into the lower end of a setting chamber 30 which is defined by the concrete liner 26.

A manhole cone 32 of eccentric configuration is mounted on the open upper end of the concrete liner 26 and the open top 34 of the manhole cone is located slightly below the finished grade of the ground level. A ring and removable grate assembly 36 of conventional configuration is mounted on the top of the manhole cone 32 to admit drain water into the settling chamber 30 of the drywell structure 10. The liner 26, manhole cone 32 and the ring and grate assembly 36 are herein referred to as the drain water receiving means.

As shown in FIG. 1, a second rock pack 38 is placed in the larger diameter upper portion 12 of the drywell so as to surround the concrete liner 26 and the lower part of the manhole cone 32. An imperforate membrane 40 is placed on top of the second rock pack 38 and the remainder of the large diameter portion 12 of the drywell in back filled with appropriate surface materials. For example, when the drywell structure 10 is located in a roadway or other paved surface, the above mentioned final back fill will usually be made by utilizing the roadway base material 42 which is under the paved surface 44.

In accordance with the present invention, a special water filtration and intake assembly 46 is provided in the settling chamber 30 of the drywell structure 10. The filtration and intake assembly 46 includes a perforated water intake pipe 48 formed of any suitable material such as expanded metal sheet which is rolled and welded into a pipe-like configuration, Polyvinyl Chloride having a plurality of apertures 50 formed along its length. The intake pipe 48 has it lower end mounted in the upwardly opening end of the previously mentioned coupler fitting 28 so that the intake pipe is in liquid communication with the drain pipe 16 and extends upwardly from the bottom of the settling chamber 30. The entire water filtration and water intake assembly 46 is held in the upstanding position by at least one clamping means 51 as shown in FIG. 1. The intake pipe 48 has its upper end disposed proximate and somewhat below the top of the concrete liner 26 and the top of the pipe is closed by means of a suitable cap 52.

Figure 3:
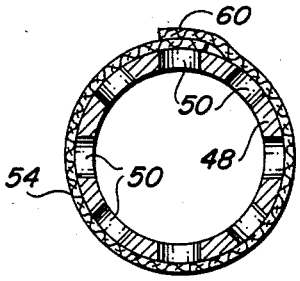
FIG. 3 is an enlarged sectional view taken along the line 3—3 of FIG. 2.

The perforated water intake pipe 48 is covered by a filtration fabric 54 which is wrapped about the pipe's periphery so as to totally cover the pipe. The fabric 54 has its lower end 56 interposed between the lower end of the intake pipe 48 and the coupler fitting 28. In this way, the lower end 56 of the fabric 54 is firmly held in place. Likewise, the upper end 58 of the fabric 64 is interposed between the pipe 48 and the depending skirt portion of the closure cap 52. As shown in FIG. 3, the filtration fabric 54 is preferably a single layer which is wrapped around the intake pipe 48 so that the opposed longitudinal edges of the fabric are overlapped to form a seam-like joint 60. The joint 60 is preferably made by utilization of a suitable adhesive which, of course, cannot be water soluble and should be resistant to ultra-violet attack.

The preferred filtration fabric, which is sometimes referred to as a geotextile, or geotechnical, fabric, is a non-woven synthetic fabric of the type developed specifically for soil engineering purposes and is used generally as a soil/water filtration medium. Such fabrics may be made of polyester, polypropylene or any other suitable material which provides the fabric with a high grab strength such as approximately 150 pounds, a high trapezoid tear strength of about 70–80 pounds or better, and provides the fabric with a permeability which allows a flow rate of approximately 270 gallons/square foot/-min. The American Enka Co. of Enka. N.C. 28728 markets a family of non-woven polyester filtration fabrics under its brand name Stabilenka.

In view of the foregoing, the operation of the drywell structure 10 of the present invention should be apparent. Briefly, drain water entering the settling chamber 30 through the ring and grate assembly 36 will begin to flow through the filtration fabric 54 into the intake pipe 48 almost immediately, e.g. as soon as the water level in the settling chamber rises above the top of the coupler fitting 28. By virtue of the drain water passing through the filtration fabric, most, if not all, of the silt and other foreign materials carried into the settling chamber 30 by the water, will remain in the settling chamber. Filtration of the water in this manner results in a build-up of the filtered out materials in the settling chamber. Thus, periodic removal of the collected materials will be required. The filtered drain water which enters into the intake pipe 48 will flow downwardly through the drain pipe 16 and will be leached out into the soil around the drywell through the rock interface. In that the drain water is filtered, the useful life of the drywell structure 10 will be extended considerably beyond the useful life of the prior art drywell structures.

It will be noted that the chamber 30 defined by the concrete liner 26 is herein referred to as a settling chamber. In the prior art, this chamber is truly a settling chamber and is commonly referred to in this manner in the industry. However, due to the drywell structure 10 of the present invention operating on a filtration principle rather than a settling/overflow principle, the chamber 30 of the drywell structure 10 may be more appropriately referred to as a collection chamber, or trap.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. An improved drywell structure of the type having a liner means below a ground surface and having an open top in liquid receiving communication with the ground surface, said liner means defining a chamber for receiving drain water from the ground surface and directing it into a depending drain pipe means which leaches the water into subterranean soil, said improvement comprising:

a drain water filtration and intake means in the chamber defined by the liner means and in liquid communication with the depending drain pipe means for filtration of silt and other foreign materials from the drain water prior to its being directed into the depending drain pipe means, said drain water filtration and intake means including.

(a) a perforated intake pipe in the chamber defined by the liner means of the drywell structure, said intake pipe having one end which is in liquid communication with the depending drain pipe means and having a closed opposite end, and (b) a filtration fabric mounted on the periphery of said intake pipe so as to cover at least the perforations thereof.

2. An improved drywell structure as claimed in claim 1 wherein said perforated intake pipe extends upwardly from the bottom of the liner means of the drywell structure.

3. An improved drywell structure as claimed in claim 2 wherein the lower end of said intake pipe is the one which is in liquid communication with the depending drain pipe means and the upper end of said intake pipe is the closed opposite end.

4. An improved drywell structure as claimed in claim 1 wherein said drain water filtration and intake means further comprises:

(a) said intake pipe being mounted in a vertical attitude in the liner means of the drywall structure, said intake pipe having a bottom end which is the one that is in liquid communication with the depending drain pipe means, a top end which is the closed opposite end thereof and a plurality of apertures formed along its length to provide the perforations of said intake pipe;

(b) a coupling fitting on the upper end of the depending drain pipe means, the bottom end of said intake pipe being mounted in said coupling fitting;

(c) a cap on the top end of said intake pipe for closing thereof; and (d) said filtration fabric being wrapped about the periphery of said intake pipe so as to completely cover the periphery of said intake pipe.

5. An improved drywell structure as claimed in claim 4 wherein said filtration fabric has an upper end which is interposed between the top end of said intake pipe and said cap for holding the top end of said filter fabric in place.

6. An improved drywell structure as claimed in claim 4 wherein said filtration fabric has a lower end which is interposed between the bottom end of said intake pipe and said coupling fitting in which the bottom end of said intake pipe is mounted.

7. A drywell structure as claimed in claim 4 wherein said filtration fabric is a non-woven polyester.

8. A drywell structure as claimed in claim 4 wherein said filtration fabric is a non-woven polypropylene.

9. A drywell structure as claimed in claim 4 wherein said filtration fabric is formed of a non-woven synthetic resin having a grab strength of approximately 150 pounds, a trapezoid tear strength of at least 70–80 pounds and has a permeability which allows a flow rate of approximately 270 gallons/square foot/minute.

10. A drywell structure for receiving drain water from a ground surface and directing it to subterranean soils comprising in combination:

(a) water receiving means defining a chamber and having an open top, said water receiving means being located below the ground surface for receiving drain water therefrom in its chamber;

(b) drain pipe means having an upper end proximate the bottom of the chamber defined by said water receiving means and depending therefrom into the subterranean soils; and (c) drain water filtration and intake means in the chamber defined by said water receiving means and being in liquid communication with the upper end of said drain pipe means, said drain water filtration and intake means being for filtering silt and other foreign materials from the drain water received in the chamber of said water receiving means and directing filtered water to said drain pipe means.

11. A drywell structure as claimed in claim 10 wherein said drain water filtration and intake means comprises:

(a) a perforated intake pipe in the chamber of said water receiving means and having one end coupled to the upper end of said drain pipe means; and (b) a filtration fabric mounted on the periphery of said intake pipe so as to cover the perforations thereof.

12. A drywell structure as claimed in claim 11 wherein said perforated intake pipe is elongated and is vertically disposed in the chamber defined by said water receiving means.

13. A drywell structure as claimed in claim 12 and further comprising:

(a) a coupling fitting means on the upper end of said drain pipe means;

(b) said intake pipe having the one end thereof mounted in said coupling fitting and having an opposite top end; and (c) a cap on the top end of said intake pipe for closing thereof.

14. A drywell structure as claimed in claim 10 wherein said drain water filtration and intake means comprises:

(a) an elongated perforated intake pipe mounted in a substantially vertical attitude in the chamber of said water receiving means, said intake pipe having a bottom end and a top end;

(b) a coupling fitting means on the upper end of said drain pipe means and having the bottom end of said intake pipe mounted therein;

(c) a cap on the top end of said intake pipe for closing thereof; and (d) a filtration fabric wrapped about the periphery of said intake pipe so as to cover the periphery thereof.

15. A drywell structure as claimed in claim 14 wherein said filtration fabric has an upper end which is held in place by being interposed between said intake pipe and said cap.

16. A drywell structure as claimed in claim 14 wherein said filtration fabric has a lower end which is held in place by being interposed between said intake pipe and said coupling fitting means.

17. A drywell structure as claimed in claim 14 wherein said filtration fabric is a non-woven polyester.

18. A drywell structure as claimed in claim 14 wherein said filtration fabric is a non-woven polypropylene.

19. A drywell structure as claimed in claim 14 wherein said filtration fabric is formed of a non-woven synthetic resin having a grab strength of approximately 150 pounds, a trapezoid tear strength of at least 70–80 pounds and has a permeability which allows a flow rate of approximately 270 gallons/square foot/minute.

* * * * *